United States Patent [19]

McKinney

[11] Patent Number: 4,632,438

[45] Date of Patent: Dec. 30, 1986

[54] ADJUSTABLE SAFETY LATCH WITH INOPERABLE POSITION

[76] Inventor: James C. McKinney, 8850 North Mount Dr., Alpharetta, Ga. 30201

[21] Appl. No.: 754,609

[22] Filed: Jul. 12, 1985

Related U.S. Application Data

[63] Continuation-in-part of Ser. No. 696,076, Jan. 29, 1985.

[51] Int. Cl.[4] ..... E05C 19/06

[52] U.S. Cl. ..... 292/87; 292/DIG. 60

[58] Field of Search ..... 292/80, 87, DIG. 60, 292/341.18, 341.19; 248/544, 496, 354.7; 24/586, 683, 685, 686

[56] References Cited

U.S. PATENT DOCUMENTS

| | | | |
|---|---|---|---|
| 1,720,467 | 7/1929 | Cheney | 292/DIG. 42 X |
| 2,042,297 | 5/1936 | Craighead | 292/19 X |
| 2,203,202 | 6/1940 | Kun | 292/87 |
| 2,798,754 | 7/1957 | Russell | 292/341.18 |
| 4,068,872 | 1/1978 | Smith | 292/87 |
| 4,416,477 | 11/1983 | Bialobrzeski et al. | 292/87 X |
| 4,492,397 | 1/1985 | Allenbaugh | 292/341.18 |
| 4,503,692 | 3/1985 | Grint | 70/417 X |
| 4,544,192 | 10/1985 | Angle et al. | 292/341.18 |

FOREIGN PATENT DOCUMENTS

| | | | |
|---|---|---|---|
| 470770 | 1/1929 | Fed. Rep. of Germany | 248/354.7 |

*Primary Examiner*—Robert L. Wolfe
*Assistant Examiner*—Russell W. Illich
*Attorney, Agent, or Firm*—James B. Middleton

[57] ABSTRACT

A child proof safety latch for a cabinet door or drawer. The safety latch includes a base plate receivable on the door, with a hook extending from the base plate to engage the cabinet. A holding plate is provided to locate the base plate, and the holding plate and base plate have teeth for ratchet adjustment of the base plate. A screw passes through the holding plate and the base plate to secure the latch to the door, and the latch is rotatable to place the hook in a position so the hook will not engage the cabinet. The latch therefore has an operable position and an inoperable position.

6 Claims, 6 Drawing Figures

Fig. 1
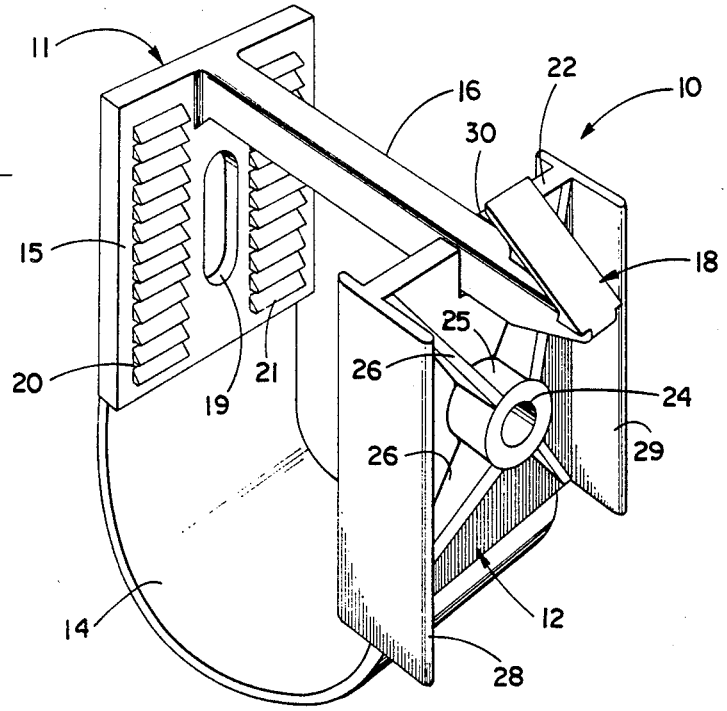
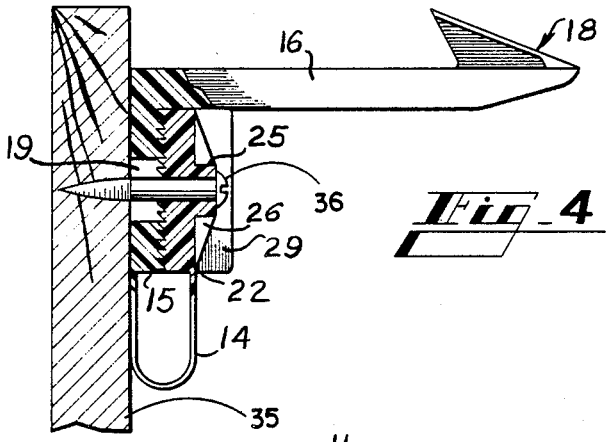
Fig. 4
Fig. 3
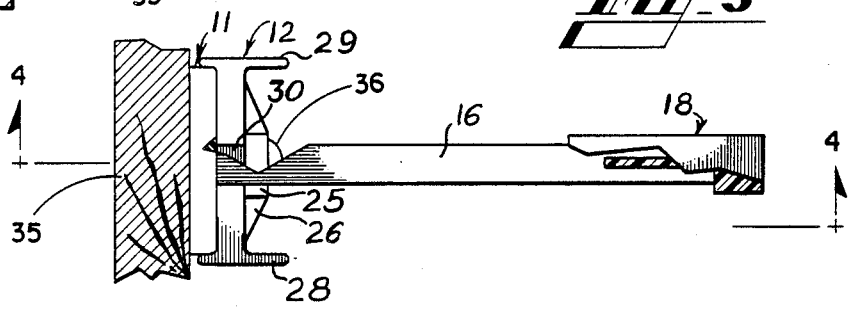

ADJUSTABLE SAFETY LATCH WITH INOPERABLE POSITION

CROSS-REFERENCE TO RELATED APPLICATION

This application is a continuation-in-part of the application of the same inventor titled "Adjustable Safety Latch", filed Jan. 29, 1985, under Ser. No. 696,076.

INFORMATION DISCLOSURE STATEMENT

It is known in the art to provide a safety latch for cabinet doors, drawers and the like, such latches being arranged to prevent a door or drawer from opening except very slightly. The safety latch can be disengaged by reaching through the partially open door or drawer and manipulating the latch to allow the door or drawer to open fully. While the disengagement of the safety latch is relatively easy for an adult, small children will not know how to manipulate the latch, and may not have the strength to manipulate the latch so such latches tend to prevent a child from having access to the contents of a cabinet or a drawer.

While many such safety latches have been devised, and several such safety latches have been marketed, the latches are usually designed for a very specific cabinet arrangement so that a given latch will fit relatively few cabinet arrangements. Also, the prior art safety latches have generally required separate installation and adjustment of two or more pieces, and such adjustment within the confined spaces is quite difficult. If the latch is installed and is found to be improperly adjusted, one must remove or loosen the latch, make the desired adjustments, and retighten or reinstall the latch. Furthermore, the prior art latches are generally operative as long as they are installed, and there is no simple means for rendering them inoperative.

SUMMARY OF THE INVENTION

This invention relates generally to safety latches, and is more specifically concerned with a child proof safety latch for use on drawers, cabinet doors and the like.

The safety latch of the present invention includes a hook carrying member selectively securable adjacent to an edge of a closure such as a door or drawer front. The hook carrying member can be firmly held in either an operative position or an inoperative position, and is partially releasable to be moved from one position to the other. The preferred means for securing the hook carrying member is a holding plate having a fastening means therethrough for engagement with the closure.

In one embodiment of the invention, the hook carrying member includes a plurality of teeth for engagement with complementary teeth on the holding plate. An elongate slot in the hook carrying member then allows motion of the hook carrying member with respect to the holding means for adjustment of hook position. Also, the entire assembly is rotatable about the fastening means for moving the assembly between operative and inoperative positions.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a safety latch made in accordance with the present invention, and showing the holding means separated from the hook carrying member;

FIG. 3 is a top plan view of the latch shown in FIG. 1, portions being broken away to show the construction;

FIG. 4 is a cross-sectional view taken substantially along the line 4—4 in FIG. 3;

DETAILED DESCRIPTION OF THE EMBODIMENT

Figure 2:
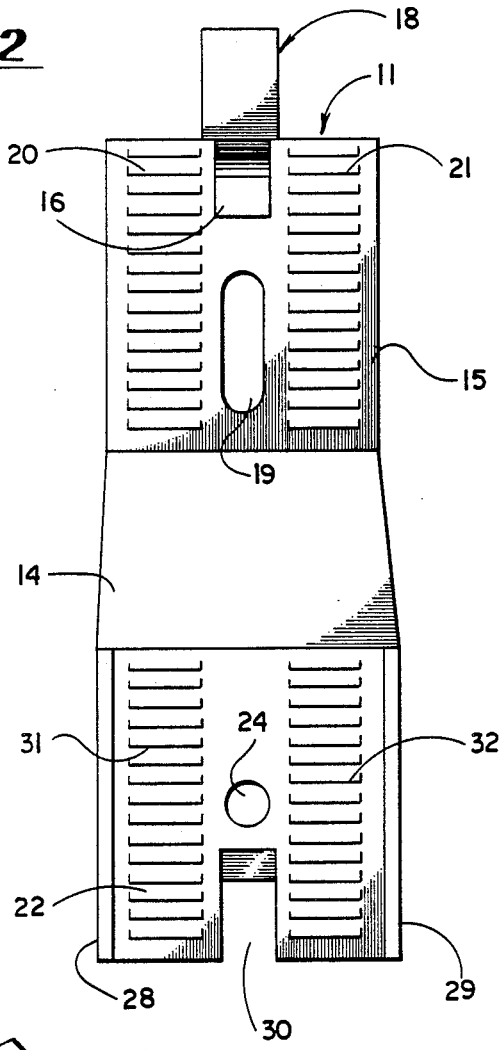
FIG. 2 is a front elevational view of the latch shown in FIG. 1, with the hook carrying member and holding means oriented as they may be molded.

Referring now more particularly to the drawings, and to that embodiment of the invention here presented by way of illustration, FIG. 1 shows a latch assembly generally designated at 10 and including the hook carrying member 11 and the holding plate 12. Though latches constructed in accordance with the present invention may be made in many ways from various materials, the latch is well adapted for manufacture by injection molding of a plastic, such as polypropylene, nylon, polyester or any of numerous other materials well known to those skilled in the art. Thus, for injection molding, the entire latch as shown in FIG. 1 can be made in a single cavity by inclusion of the web 14 extending between the hook carrying member 11 and the holding plate 12.

Though the arrangement here shown provides an excellent latch, it will also be understood that the pieces may be made separately, or may have score lines for easy subsequent separation.

Looking at the hook carrying member 11 in more detail, it will be seen that the member 11 includes a base plate 15 that is generally rectangular, and has the shank 16 of the hook 18 extending therefrom adjacent to the upper edge. Below the shank 16, the plate 15 has an elongate opening 19 for receiving a fastening means. This will be discussed in more detail hereinafter.

The front face of the base plate has a plurality of teeth thereon, here shown as two rows 20 and 21. The teeth 20 and 21 are intended to allow adjustment in one direction, so the teeth are here shown as having flat lower surfaces, generally perpendicular to the base plate 15, and sloping upper surfaces.

Turning next to the holding means 12, the holding means also includes a plate, specifically a holding plate 22 having a central, circular opening 24. The opening 24 is through a boss 25 having strengthening ribs 26.

It will be understood that the holding plate 22 is of about the same width as the base plate 15. To assist in maintaining alignment between the two plates, the holding plate 22 has side flanges 28 and 29 so the base plate 15 is received between the two flanges 28 and 29. To allow for the shank 16 of the hook 18, the upper edge of the holding plate 22 has a notch 30.

With attention to FIG. 2 as well as FIG. 1, it will be seen that the holding plate 22 also has a plurality of teeth, the teeth being arranged in two rows 31 and 32, vertically aligned with the teeth 20 and 21 in FIG. 2. The result is that, when the two plates 15 and 22 are placed together, the teeth 20 and 31 will match, and the teeth 21 and 32 will match and interengage.

As is best shown in FIGS. 3 and 4, the base plate 15 is placed against the closure 35, and the base plate 15 is held in place by the holding plate 22. The flanges 28 and 29 engage the side edges of the base plate 15 to maintain alignment, and a fastening means, such as the screw 36, holds the holding plate 22 in position. Since the opening 19 is elongated and the hole 24 is a discrete round hole, it will be understood that a screw can be passed through the two holes 19 and 24, and the base plate 15 can be vertically adjusted without removing the screw 36.

Looking especially at FIG. 4, operation of the device should be understood. The hook carrying member 11 will be appropriately placed on the closure 35, and the holding member 12 will be placed over the hook carrying member. The shank 16 will be received in the notch 30, and the flanges 28 and 29 will be positioned at each side of the base plate 15.

With the boss 25, it will be recognized that a screw 36 can be placed through the hole 24 and the hole 19, and the screw will be supported for easy starting, and the screw can be forced into the closure 35 without drilling pilot holes or the like.

When the screw 36 is almost tight, the hook carrying member 11 can be urged up if needed. The teeth will slip with respect to one another because sloped surfaces engage each other; however, the teeth will not slip in the opposite direction because flat surfaces engage each other. To move the plates in the opposite direction, therefore, the screw must be loosened sufficiently for the teeth to release.

As a child safety latch, the latch 10 can be installed with the hook carrying member 1 quite low on the closure so the hook 18 barely engages the cabinet. In this condition, an adult will find it very easy to open the cabinet while a very small child will be unable to open it. As the child matures and is able to open the cabinet, the screw 36 can be loosened slightly, and the hook carrying member 11 moved up a click or two, causing the hook 18 to overlap the cabinet to a greater extent to require more force to open the cabinet.

In many instances, it is desirable to have a safety latch operable at times, and inoperable at other times. For example, a mobile home, camper or the like having cabinets needs to have the cabinets secure for travel, but easily useable otherwise. Also, people who have small children visit, but not present permanently, need to latch the cabinets when children are present but to render the cabinets easily useable when children are not present. The latch of the present invention is admirably suited to these situations since the latch is easy to shift from operative to inoperative position.

Realizing that the entire latch 10 is held by a single screw 36 or other fastening means, the latch is readildy rotatable, by loosening the screw if required. Considering that the hook 18 is set to engage a stationary portion of a cabinet when the closure 35 is moved away from the stationary portion, it will be understood that the latch can be made inoperative by rotating the hook 18 to one side so the hook 18 can no longer engage the cabinet.

Figure 5:
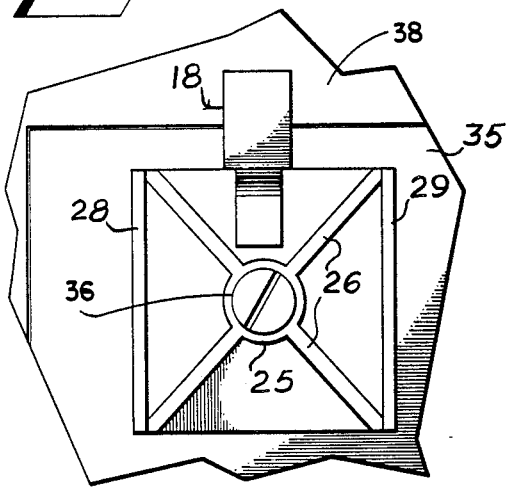
FIG. 5 is an elevational view of a latch made in accordance with the present invention and showing the latch in operative position on a closure; and, FIG. 6 is a view similar to FIG. 5 and showing the latch in inoperative position.
Figure 6:
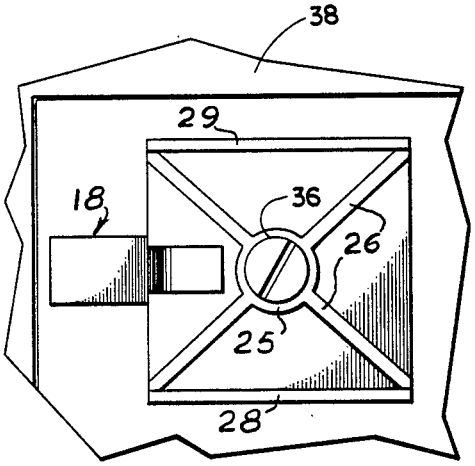

In FIGS. 5 and 6, the closure 35 is shown having the latch 10 thereon. In FIG. 5, the hook 18 is in position so the hook will engage the frame 38 when the closure 35 is moved outwardly. FIG. 6, however, shows the latch 10 rotated 90°, and the hook 18 is no longer in position to engage the frame 38.

It will therefore be seen that the latch of the present invention is very simple, but provides economy of manufacture and versatility in use. The latch can be injection molded as a single piece if desired, only the securing means being additionally necessary. The pieces of the latch can be held together as by the web 14, or the pieces can be separately molded, or molded as a unit and subsequently separated.

It will therefore be understood by those skilled in the art that the particular embodiment of the invention here presented is by way of illustration only, and is meant to be in no way restrictive; therefore, numerous changes and modifications may be made, and the full use of equivalents resorted to without departing from the spirit or scope of the invention as defined in the appended claims.

What is claimed is:

1. A safety latch in combination with a closure for a cabinet for preventing access to a cabinet or the like by preventing full opening of said closure for said cabinet, said safety latch including a hook carrying member receivable on said closure adjacent to a movable edge thereof, said hook carrying member including a base plate disposable on said closure, and a hook extending therefrom, said base plate defining an opening therethrough, securing means extending through said opening in said base plate, said opening in said base plate being larger than said securing means so that said base plate can move along the surface of said closure relative to said securing means, placement means for locating said base plate on said closure, said placement means defining a second plate having a hole generally centrally thereof for rotatably receiving said securing means, said securing means engaging said placement means for holding said placement means against said base plate and said base plate against said closure, said base plate disposed between said closure and said second plate, and means carried by said placement means for preventing relative rotation between said base plate and said placement means, said hook member extending generally perpendicularly from said base plate for selective engagement with said cabinet, said hook member being sufficiently resilient to be forcefully bent for disengagement from said cabinet, the arrangement being such that said placement means is rotatable on said securing means and said base plate is slidable relative to said placement means for varying the position of said hook with respect to said closure, said opening in said base plate being of such size as to allow placement of said hook so that rotation of said latch about said securing means will prevent said hook from engaging said cabinet.

2. A safety latch as claimed in claim 1, said base plate further including a first plurality of teeth, said placement means including a holding plate having a second plurality of teeth, said first plurality of teeth being interengageable to prevent relative motion in at least one direction.

3. A safety latch as claimed in claim 2, said means for preventing relative rotation comprising a pair of flanges on opposite sides of said holding plate, said base plate being receivable between said flanges for maintaining rotational alignment of said base plate and said holding plate.

4. A safety latch as claimed in claim 2, said first and second plurality of teeth constituting ratchet means, said first plurality of teeth and said second plurality of teeth being engageable to allow said base plate to be moved towards said edge of said closure and to restrain motion in the opposite direction.

5. A safety latch as claimed in claim 3, said holding plate including a boss having said hole therethrough, said securing means comprising a screw, said boss constituting screw holding means for installation of said safety latch.

6. A safety latch as claimed in claim 5, and further including a flexible web extending from said base plate to said holding plate.

* * * * *